US006922864B2

(12) United States Patent
Clarke et al.

(10) Patent No.: US 6,922,864 B2
(45) Date of Patent: Aug. 2, 2005

(54) MULTIPLE PURPOSE TOOL

(76) Inventors: Gary Richard Clarke, 202A-1583 Ellis Street, Kelowna, British Columbia (CA), V1Y 2A7; Jim Keller, 202A-1583 Ellis Street, Kelowna, British Columbia (CA), V1Y 2A7; Bob Storz, 202A-1583 Ellis Street, Kelowna, British Columbia (CA), V1Y 2A7

( * ) Notice: Subject to any disclaimer, the term of this patent is extended or adjusted under 35 U.S.C. 154(b) by 0 days.

(21) Appl. No.: 10/718,594

(22) Filed: Nov. 24, 2003

(65) Prior Publication Data

US 2004/0129119 A1 Jul. 8, 2004

Related U.S. Application Data

(60) Provisional application No. 60/437,737, filed on Jan. 3, 2003.

(51) Int. Cl.[7] ..... B25F 1/00

(52) U.S. Cl. ..... 7/143; 7/167; 81/489

(58) Field of Search ..... 7/143, 146, 167, 7/147; 81/489, 490, 492, 20–27, 124.6, 125.1, 177.1, 177.3

(56) References Cited

U.S. PATENT DOCUMENTS

| | | | | | |
|---|---|---|---|---|---|
| 172,277 | A | * | 1/1876 | Norris | 7/142 |
| 312,221 | A | * | 2/1885 | Pruim | 7/101 |
| 772,912 | A | | 10/1904 | Allam | |
| 1,168,185 | A | * | 1/1916 | Fleck | 81/439 |
| 1,613,976 | A | * | 1/1927 | Bellows | 81/124.5 |
| 1,980,087 | A | * | 11/1934 | Rast | 81/489 |
| 2,951,405 | A | * | 9/1960 | Engquist | 81/440 |
| 3,561,510 | A | | 2/1971 | Johnson | |
| 3,799,226 | A | * | 3/1974 | Lavietes | 81/63.2 |
| 3,979,163 | A | * | 9/1976 | Beard | 401/139 |
| 4,125,913 | A | * | 11/1978 | Lewis | 7/138 |
| 4,672,745 | A | * | 6/1987 | Wilkens | 30/340 |
| 4,741,059 | A | * | 5/1988 | Lee et al. | 7/127 |
| 5,086,674 | A | * | 2/1992 | Her | 81/124.4 |
| 5,237,715 | A | * | 8/1993 | Bane, III | 7/139 |
| 5,272,942 | A | * | 12/1993 | Hull et al. | 81/124.4 |
| 5,315,724 | A | * | 5/1994 | Trujillo et al. | 7/145 |
| 5,432,968 | A | * | 7/1995 | Beck | 7/128 |
| 5,759,120 | A | * | 6/1998 | Mathis et al. | 473/408 |
| 5,845,354 | A | | 12/1998 | Long et al. | |
| 5,970,553 | A | * | 10/1999 | Lin | 7/143 |
| 6,435,065 | B2 | | 8/2002 | Kozak et al. | |
| 2002/0069484 | A1 | * | 6/2002 | Creel | 16/430 |
| 2002/0162429 | A1 | | 11/2002 | Purkapile | |
| 2002/0178873 | A1 | * | 12/2002 | Hsieh | 81/125.1 |

FOREIGN PATENT DOCUMENTS

| | | | | | |
|---|---|---|---|---|---|
| JP | 2003019674 | A | * | 1/2003 | B25D/1/00 |

* cited by examiner

*Primary Examiner*—David B. Thomas
(74) *Attorney, Agent, or Firm*—Antony C. Edwards

(57) ABSTRACT

A multi purpose hand tool includes an elongate generally cylindrical handle having opposite first and second ends. The handle is adapted for grasping by a user and has a hole through the handle located substantially mid-way along the length of the handle. The hole extends through the handle so that a digit of the user's hand, when grasping the handle, may be inserted through the hole.

22 Claims, 10 Drawing Sheets

MULTIPLE PURPOSE TOOL

CROSS REFERENCE TO RELATED APPLICATION

This application claims priority from U.S. Provisional Patent Application No. 60/437,737 filed Jan. 3, 2003 entitled Hand or Palm Held Multi-tool, Bumper, Tapper, Hammer and Driver.

FIELD OF THE INVENTION

This invention relates to the field of hand held tools and in particular to a multi-purpose palm-held tool having a ratchet driver at one end and an impact driver at an opposite end.

BACKGROUND OF THE INVENTION

There still exists a need in the prior art for a convenient and simple to operate multi-purpose tool which will allow a person typically using the tool at home to, when standing for example on the top of a step ladder, to without the need for multiple trips up and down the ladder to hang a picture or string Christmas lights or conduct many other simple assembly requiring screwing, ratcheting or hammering. Consequently, in the present invention, it is an object to provide a hand-held tool implement wherein, in a single tool, one end of the tool provides an impact driver in the form of a hammer or mallet type head, and the other end of the tool provides an interchangeable bit ratcheting driver for driving screws or Allen-head bolts. In one preferred embodiment, the generally cylindrical body which extends between the opposite ends of the tool has a through-bore or aperture generally medially positioned along the length of the tool sized for sliding fitment therethrough of the forefinger of a user.

In the prior art of which applicant is aware, there are many designs for ratcheting screwdrivers. For example at least as early as the screwdriver which is the subject of U.S. Pat. No. 147,654 which issued to Kneeland on Feb. 17, 1874, and which more recently were followed on by many other designs of screwdrivers, whether ratcheting or having interchangeable bits, the prior art designs share the common characteristic that one end of the tool supports the driving bit and the opposite end of the tool provides a handle for grasping.

It is also commonly known in the prior art to provide, in screwdrivers wherein the bits are interchangeable, for storing the bits within a cavity in the handle of the screwdriver. One example of such a design is the subject of Published United States Patent Application No. U.S. 2001/0032531 A1 published on Oct. 25, 2001 for the Tool Handle for Storing Bits of Kozak et al. Many other examples exist in the prior art of multiple-bit hand-held drivers wherein the bits are stored within the housing of the handle. Some of these designs again provide for ratcheting and driving of a bit mounted in one end of the handle so as to expose the operative end of the bit.

What is neither taught nor suggested in the prior art of which applicant is aware, and which it is an object of the present invention to provide, is the use of the end of the tool opposite from the driving bit end as an impact driver, wherein the impact end of the tool is weighted, or at least of increased relative density, so as to assist in the driving or tapping or bumping function of the impact driver end. Further it is neither taught nor suggested in the prior art of which applicant is aware, and is an object of the present invention to provide a through-bore or aperture or hole or other like cavity in the handle adapted for insertion or journaling therethrough of the forefinger of the user which provides advantages for use of such a tool as better set out below.

SUMMARY OF THE INVENTION

The tool according to the present invention is a hammer combined with a bit driver receiver inserted or drilled into one or both ends of a handle. The female receiver provides for a number of applications including a screwdriver, hammer, pry bar, punch, drill, bore and socket or Allen wrench. The receiver may receive a ratcheting socket head that accepts bits or other drivers. The receiver may also be a threaded bore into which different threaded impact driver members or tools may be screwed for additional applications. Threaded impact driver members may have a metal face, fibreglass face and/or a rubber face oppositely disposed to a threaded end which threads into the receiver to provide a rigid surface perpendicular to the longitudinal axis of the handle to hammer or tap an object. The handle is shaped to conform to the hand or palm of the user, allowing closer access of, and increased torque applied by, the hand to the point where force is applied. A hole is drilled or formed through the handle generally perpendicular to the longitudinal axis to allow the forefinger, for instance, to be inserted through the hole. This enables additional force to be applied to work the operative end engaging the object, by increasing the ability to leverage torque and the grip on the tool.

The addition of the hole through the middle of the handle also allows the tool to be swivelled about the digit journalled through the hole, enabling the user to continue to use three fingers and thumb of the same hand to manipulate material or objects being worked with while still holding the tool.

The tool may be cylindrical in shape and contoured so that with a forefinger through the hole in the middle of the handle, that is mid-way along its length, the handle is both comfortable and provides a significant increase in user's control of the tool when it is used as a tapping or hammer device.

Different interchangeable impact driver members may be supplied with the tool. The members may be made of different materials including steel, fibreglass, plastic, bronze, brass, rubber, cork or aluminium. The members may be used as a storage holder or magazine for various bits or drivers, so that the bits may be hidden, inserted in the bore in the handle of the tool when the members are screwed into one of the receivers. Impact driver members may also be stored by snugly inserting them in the hole formed mid way along the length of the handle in the middle of the tool, and then removed when the tool is employed in some activity.

In summary, the multi purpose hand tool of the present invention includes an elongate generally cylindrical handle having opposite first and second ends. The handle is adapted for grasping by a user and has a hole through the handle located substantially mid-way along the length of the handle. The hole extends through the handle so that a digit of the user's hand, when grasping the handle, may be inserted through the hole.

The first and second ends have female receivers for releasably mounting driver tools, or the driver tools themselves mounted, on both ends of the handle so as to operably and oppositely dispose the driver tools along a longitudinal axis of the handle.

The hole may have a bore axis which is substantially perpendicular to the longitudinal axis of the handle. The handle may also be hollow in at least one of its ends for storing driver bits therein.

Advantageously, the driver tools are, at the first end, a rigid impact-driver member, such as a hammer head, having a planar impact-driving face perpendicular to the longitudinal axis of the handle, and, at the second end, a fastener driving means. The fastener driving means may include a screw driving bit selected from a plurality of different fastener driving bits and a ratchet mechanism. The impact-driver member has the impact-driving face on an exposed end and may have a bit storage magazine on an opposite end adapted to fit, advantageously snugly fit, into the hollow end of the handle. Releasable mounting means such as a threaded coupling provide for releasably mounting impact-driver member on the first end of the handle.

The outer surface of the handle may have a concave depression adjacent at least one opening of the hole. For example, the concave depression may include a pair of oppositely disposed concave depressions adjacent opposite ends of the hole. In one embodiment, the concave depressions are between the hole and the first end so that a user grasping the first end of the handle may more comfortably insert and hook the user's forefinger through the hole and grasp the impact driver end of the handle.

DETAILED DESCRIPTION OF EMBODIMENTS OF THE INVENTION

Figure 1:
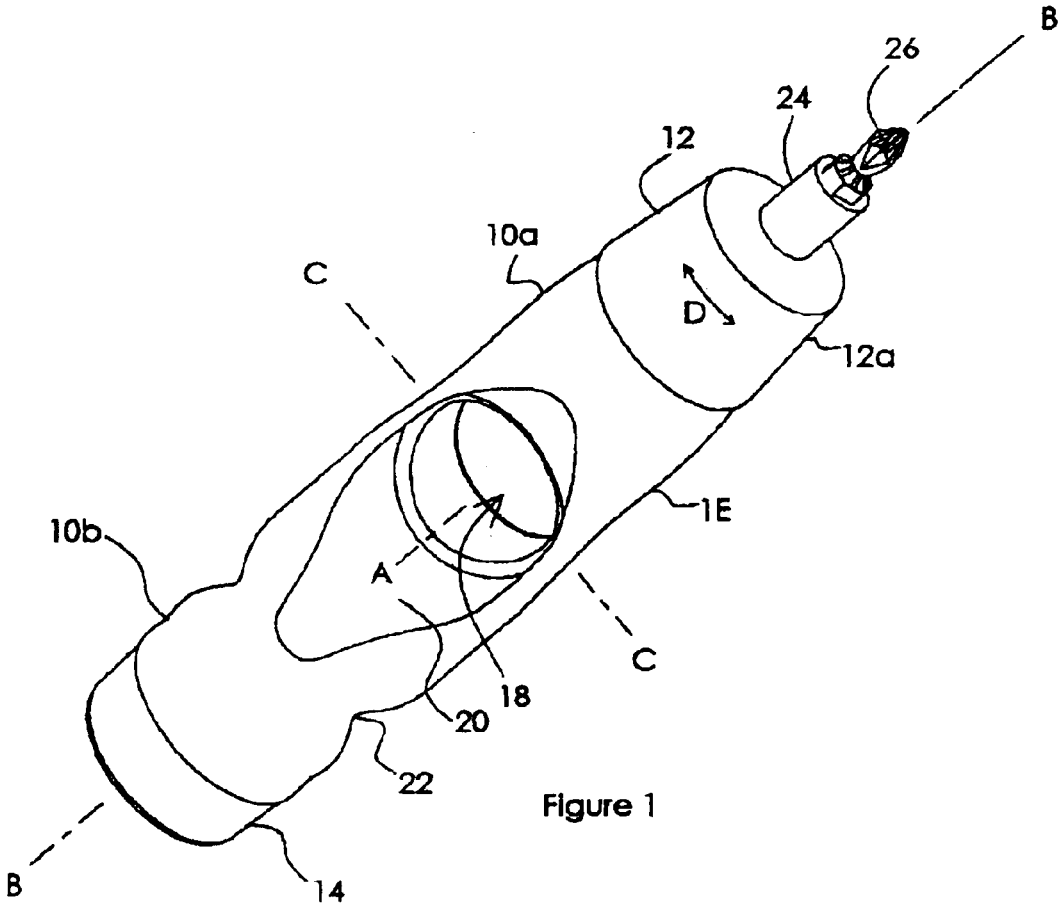
FIG. 1 is, in perspective view, the multi-purpose tool according to the present invention.

As seen in the accompanying figures wherein similar characters of reference denote corresponding parts in each view, multi purpose tool 10 according to the present invention has first and second ends 10*a* and 10*b* respectively on which are mounted, again respectively, a ratchet driver 12 and impact driver 14. A generally cylindrical grip or handle 16 extends rigidly between opposite first and second ends 10*a* and 10*b*. A through-bore 18 is formed in handle 16. The axis of symmetry A of through-bore 18 is advantageously substantially orthogonal to the longitudinal axis of symmetry B of handle 16 and to axis C which substantially medially bisects the length of handle 16.

Figure 3:
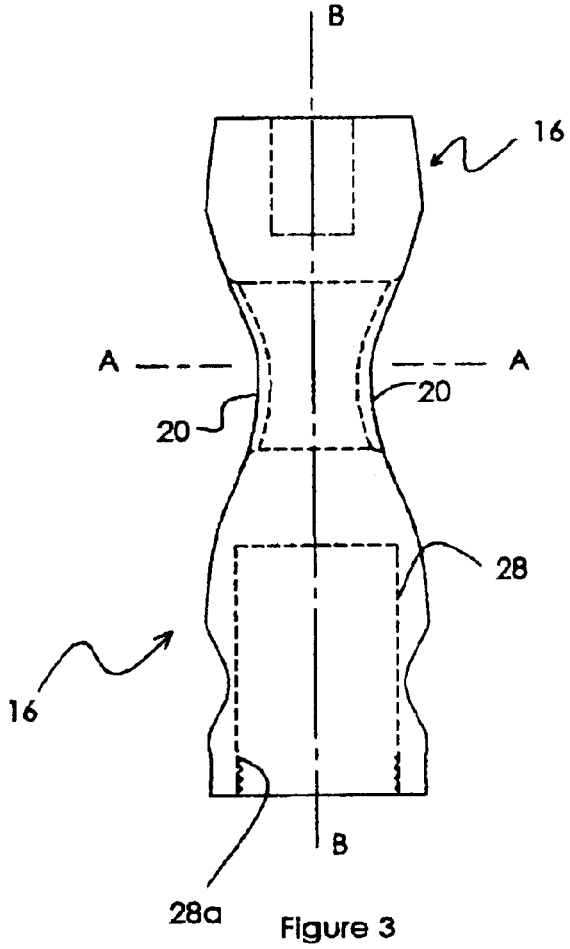
FIG. 3 is, in side elevation view, the handle of the tool of FIG. 2.
Figure 4:
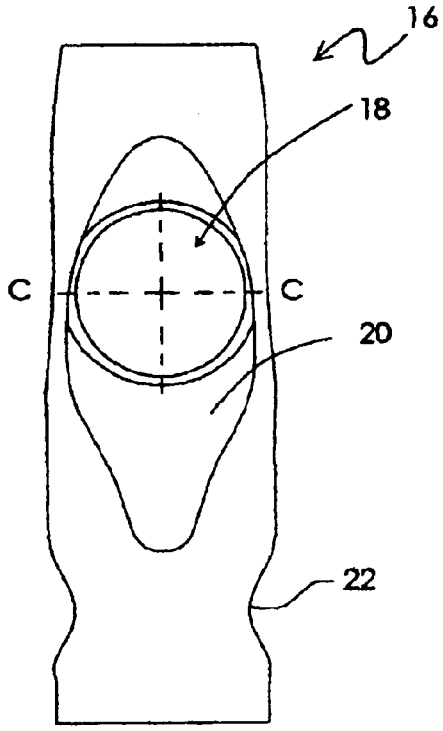
FIG. 4 is, in front elevation view, the handle of FIG. 3.

Handle 16 may be smoothly contoured for comfort and ease of grasping, for example, by the provision of concave waisting 20 symmetrically disposed on opposite sides of handle 16 as seen in FIG. 3. The base end of handle 16 towards second end 10*b* may also be contoured with a smoothly concave neck 22 which encircles handle 16.

Ratchet driver 12 may contain a conventional ratchet driving mechanism whereby housing 12*a* may be rotated about axis B in direction D relative to handle 16 so as to set the direction of the ratchet operation. With the direction of ratchet operation set by rotation of housing 12*a* relative to handle 16, bit holder 24 and any bit 26 held within holder 24 for example by inserting into a cavity within the end of bit holder 24 and held magnetically therein, is then rotated so as to drive the end of bit 26 in engagement with a fastener such as a screw in the manner of a conventional ratcheting bit driver. Ratchet driver 12 may be mounted onto end 10*a* of handle 16 by means of driver mounting flange 12*b*.

Impact driver 14 may advantageously be made of relatively dense material such as metal or rubber-like compounds so as to provide the momentum when tool 10 is being used as a hand-held impact driver in the manner of a hammer. Thus the face 14*a* of impact driver 14 is advantageously planar so as to provide an impact driving face perpendicular to the longitudinal axis B of tool 10.

Figure 2:
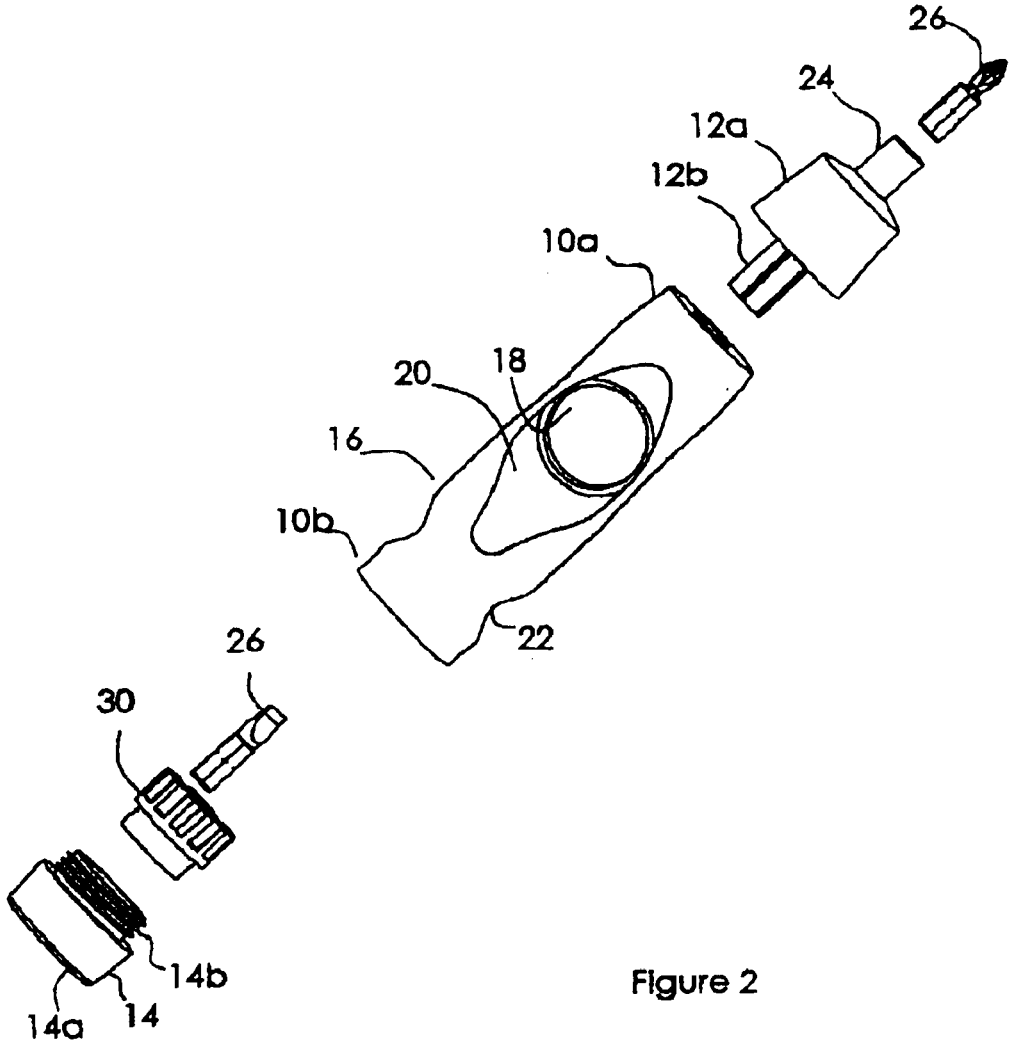
FIG. 2 is, in exploded front elevation view, the tool of FIG. 1.
Figure 5:
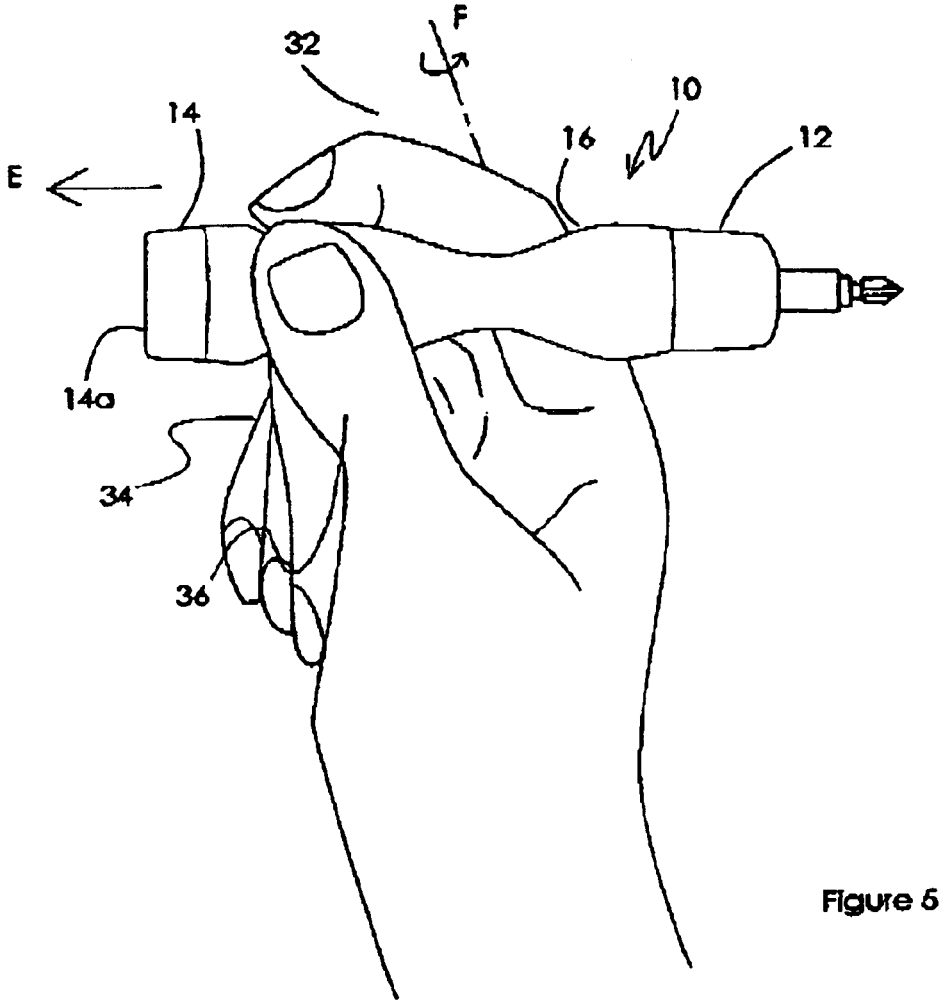
FIG. 5 is, in side elevation view, the tool of FIG. 1 being used as an impact driver.
Figure 5A:
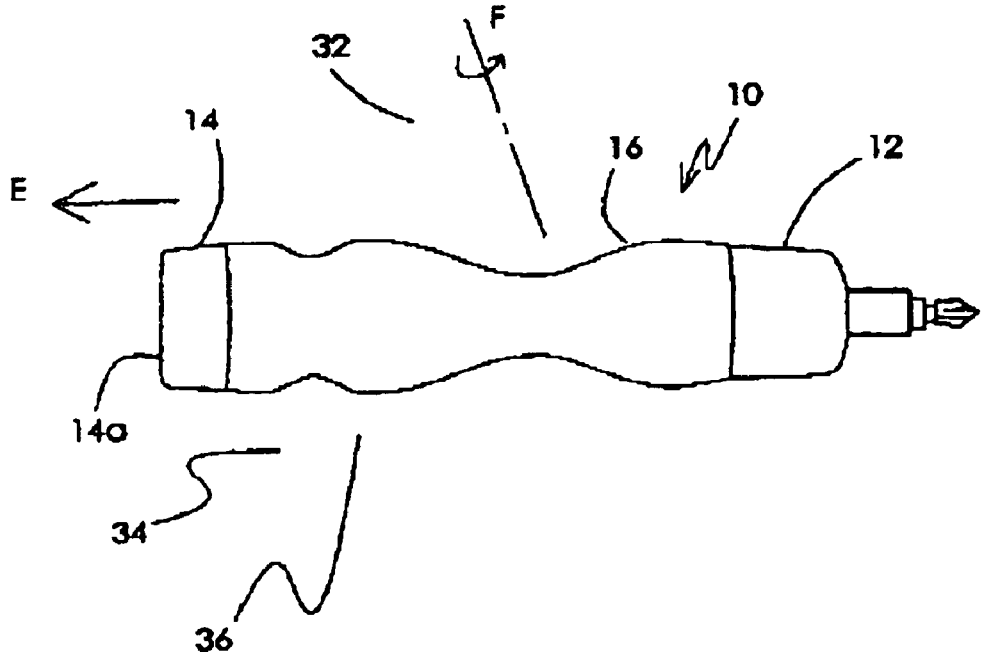

A bit storage cavity 28, shown in dotted outline in FIG. 3, may be formed within end 10*b* of handle 16. Cavity 28 is sized so as to receive therein bit magazine 30 into which are mounted a plurality of bits 26, only one being shown in FIG. 2 for sake of clarity, bit magazine 30 being mounted into the end of impact driver 14 opposite to face 14*a* with bit magazine 30 mounted into impact driver 14, impact driver 14 may be mounted, for example by means of threaded collar 14*b* into corresponding threaded engagement in threads 28*a* within cavity 28. Bits 26 snugly mount into slots formed in radially spaced array about bit magazine 30 so that with bits 26 mounted into magazine 30, and magazine 30 mounted snugly into cavity 28 and held in place by the threaded engagement of driver 14 with threads 28*a*, impact driver 14 may be employed as a hammer-like device by a user inserting a forefinger 32 through through-bore 18 as better seen in FIG. 5. With tool 10 thus grasped firmly between forefinger 32, thumb 34 and opposite finger 36, tool 10 may be driven in direction E, that is, coaxially along longitudinal axis B, so as to drive face 14*a* against the head of a fastener or other object being impact driven.

Figure 6:
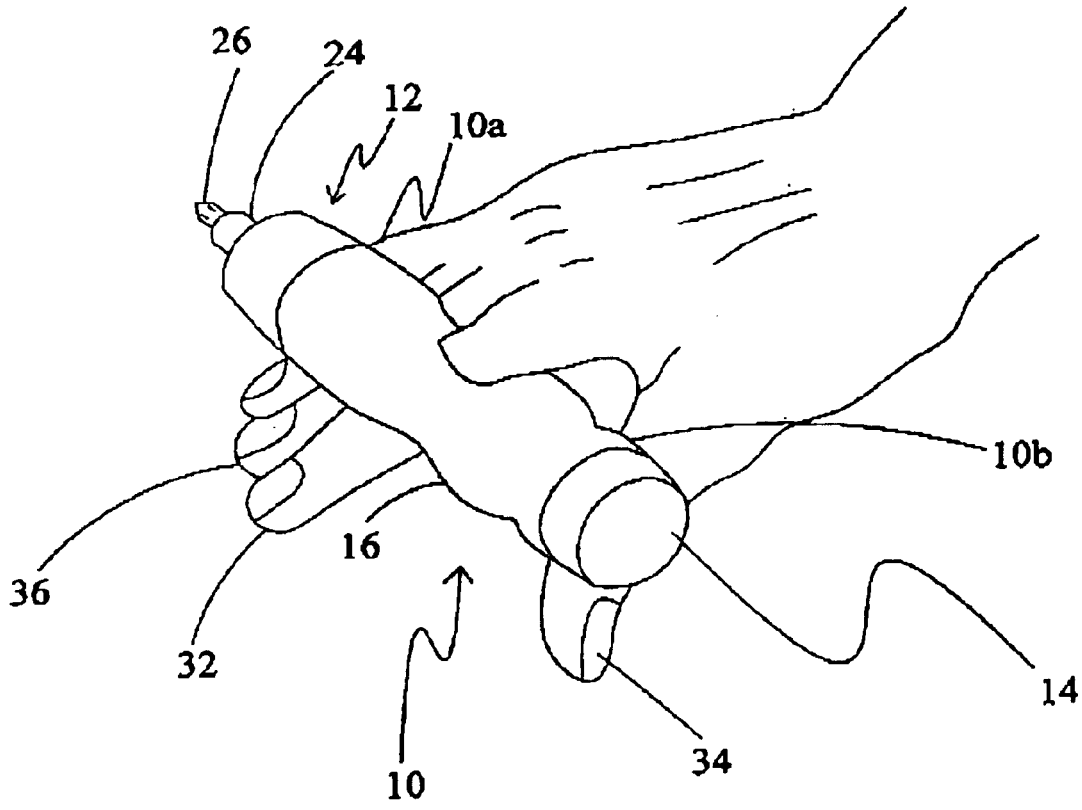
FIG. 6 is, in perspective view, the tool of FIG. 1 being carried by a user inserting a forefinger through the handle cavity.
Figure 6A:
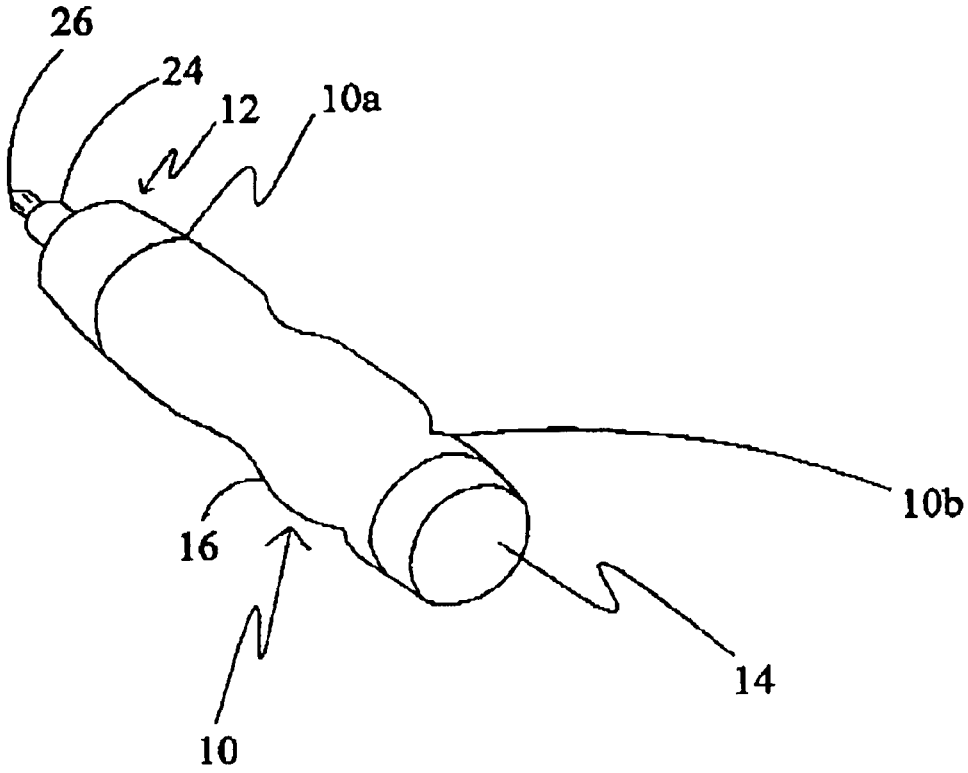
Figure 7:
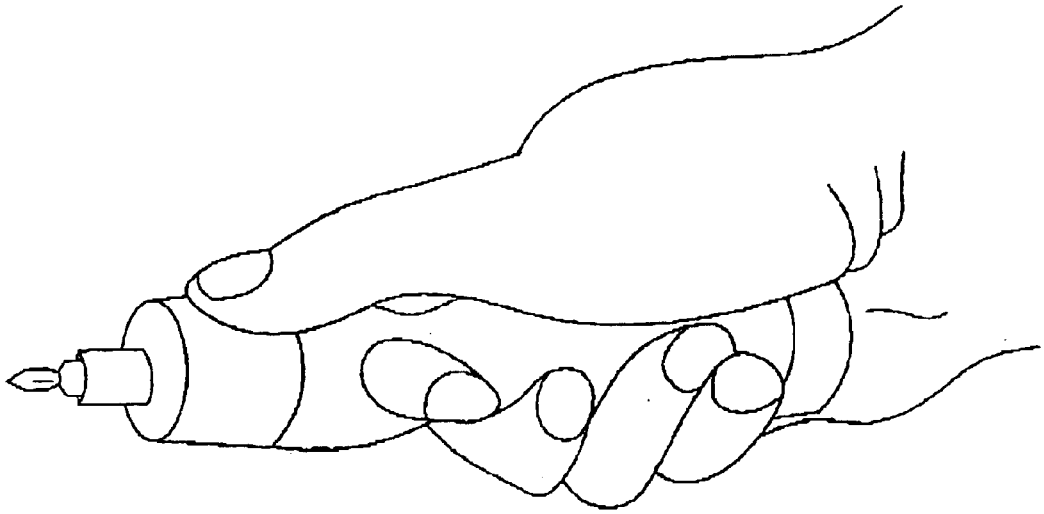
FIG. 7 is, in perspective view, the tool of FIG. 1 being used as a fastener driver.
Figure 7A:
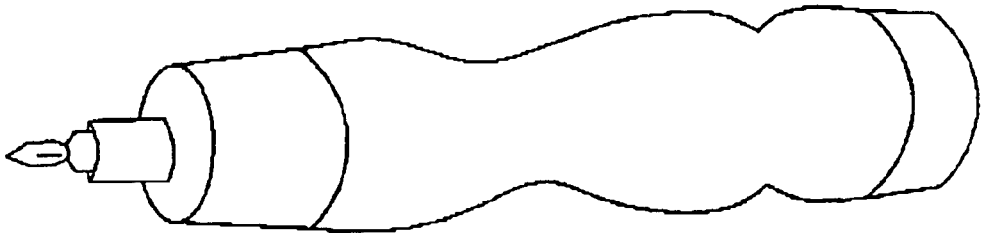
Figure 8:
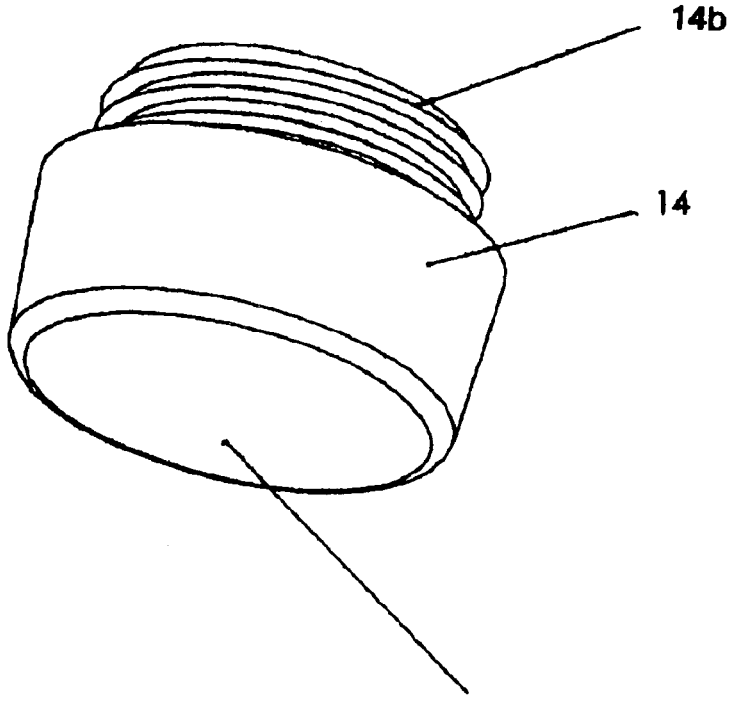
FIG. 8 is, in perspective view, the impact driver head of the tool of FIG. 1.

When the hammering function is not required, and is preferred that the user have that hand or both hands free to manipulate objects, then tool 10 is merely rotated in direction F about forefinger 32 so as to come to rest as seen in FIG. 6 behind thumb 34 and opposite finger 36. Tool 10 is thereby braced conveniently behind the user's hand freeing the user to grasp other objects between the thumb and fingers. If it is then desire to continue hammering, tool 10 is merely once again spun about forefinger 32 to bring impact driver 14 into operation. Alternatively, it is desired to use ratchet driver 12, tool 10 is spun about forefinger 32 in the opposite direction so as to bring ratchet driver 12 and the associated bit 26 held in bit holder 24 forwardly so that handle 16 and impact driver 14 may be comfortably grasped as seen in FIG. 7 for operation of the bit driver.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A multi purpose hand tool comprising:

an elongate generally cylindrical handle having opposite first and second ends, said handle adapted for grasping by a user, said handle having a hole therethrough located substantially mid-way along the length of the handle, said hole having first and second opposite openings into said hole, wherein said hole extends through said handle, said hole sized to receive through said hole a digit of the user's hand when grasping said handle insertable through said first opening of said hole so as to project through said handle and extend from said second opening of said hole, and wherein a first concave depression is formed in said handle completely around said first opening whereby said handle may be comfortably rotated about the digit of the user when the digit is inserted completely through said hole so that said first concave depression rests comfortably around a base of the digit, said first and second ends having driver tools mounted on both said ends so as to be operably and oppositely disposed along a longitudinal axis of said handle.

2. The hand tool of claim 1 wherein said hole has a bore axis which is substantially perpendicular to said longitudinal axis of said handle.

3. The hand tool of claim 1 wherein said handle is hollow in at least one end of said first and second ends for storing driver bits therein.

4. The hand tool of claim 1 wherein said driver tools are, at said first end, a rigid impact-driver member having a planar impact-driving face perpendicular to said longitudinal axis of said handle, and, at said second end, a fastener driving means.

5. The hand tool of claim 4 wherein said fastener driving means includes a screw driving bit.

6. The hand tool of claim 5 wherein said impact-driver member is a hammer head.

7. The hand tool of claim 6 wherein said hammer head has said impact-driving face on an exposed end and a bit storage magazine on an opposite end adapted to fit into said hollow end of said handle, wherein said hammer head has releasable mounting means for releasably mounting said hammer head on said first end.

8. The hand tool of claim 5 wherein said fastener driving means includes a ratchet.

9. The hand tool of claim 1 wherein a second concave depression is formed on said handle opposite said first concave depression, said second concave depression formed around said second opening of said hole.

10. The hand tool of claim 9 wherein said first and second concave depressions form a concave waisting of said handle symmetric on opposite sides of a longitudinal axis of said handle.

11. The hand tool of claim 10 wherein said concave depressions are between said hole and said first end.

12. A multi purpose hand tool comprising:

an elongate generally cylindrical handle having opposite first and second ends, said handle adapted for grasping by a user, said handle having a hole therethrough located substantially mid-way along the length of the handle, said hole having first and second opposite openings into said hole, wherein said hole extends through said handle, said hole sized to receive through said hole a digit of the user's hand when grasping said handle insertable through said first opening of said hole so as to project through said handle and extend from said second opening of said hole, and wherein a first concave depression is formed in said handle completely around said first opening whereby said handle may be comfortably rotated about the digit of the user when the digit is inserted completely through said hole so that said first concave depression rests comfortably around a base of the digit, said first and second ends having receiving means for mounting driver tools mounted on both said ends so as to operably and oppositely dispose said driver took along a longitudinal axis of said handle.

13. The hand tool of claim 12 wherein said hole has a bore axis which is substantially perpendicular to said longitudinal axis of said handle.

14. The hand tool of claim 12 wherein said handle is hollow in at least one end of said first and second ends for storing driver bits therein.

15. The hand tool of claim 12 wherein said driver tools are, at said first end, a rigid impact-driver member having a planar impact-driving face perpendicular to said longitudinal axis of said handle, and, at said second end, a fastener driving means.

16. The hand tool of claim 15 wherein said fastener driving means includes a screw driving bit.

17. The hand tool of claim 16 wherein said impact-driver member is a hammer head.

18. The hand tool of claim 17 wherein said hammer head has said impact-driving face on an exposed end and a bit storage magazine on an opposite end adapted to fit into said hollow end of said handle, wherein said hammer head has releasable mounting means for releasably mounting said hammer head on said first end.

19. The hand tool of claim 16 wherein said fastener driving means includes a ratchet.

20. The hand tool of claim 12 wherein a second concave depression is formed on said handle opposite said first concave depression, said second concave depression formed around said second opening of said hole.

21. The hand fool of claim 20 wherein said first and second concave depressions form a concave waisting of said handle symmetric on opposite sides of a longitudinal axis of said handle.

22. The hand tool of claim 21 wherein said concave depressions are between said hole and said first end.

* * * * *